US008393147B2

(12) United States Patent
Gerges

(10) Patent No.: US 8,393,147 B2
(45) Date of Patent: Mar. 12, 2013

(54) EXHAUST SYSTEM HAVING AN AFTERTREATMENT MODULE

(75) Inventor: Raymond B. Gerges, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 223 days.

(21) Appl. No.: 12/827,312

(22) Filed: Jun. 30, 2010

(65) Prior Publication Data

US 2012/0000181 A1 Jan. 5, 2012

(51) Int. Cl.

| | |
|---|---|
| ***F01N 3/10*** | (2006.01) |
| ***F01N 3/00*** | (2006.01) |
| ***F01N 1/16*** | (2006.01) |
| ***F01N 1/02*** | (2006.01) |
| ***F01N 1/08*** | (2006.01) |
| ***F01N 1/24*** | (2006.01) |

(52) U.S. Cl. ..... 60/299; 60/302; 60/306; 60/301; 60/274; 181/237; 181/254; 181/238; 181/257; 181/264

(58) Field of Classification Search ..... 60/299, 60/302, 306, 301, 274; 181/244, 212, 264, 181/236, 227, 171, 174, 198, 237, 254, 238, 181/257

See application file for complete search history.

(56) References Cited

U.S. PATENT DOCUMENTS

| | | | | |
|---|---|---|---|---|
| 2,468,384 | A * | 4/1949 | Tyskewicz | 181/240 |
| 2,818,131 | A * | 12/1957 | Doughty | 181/244 |
| 3,397,034 | A * | 8/1968 | Tulleners et al. | 423/213.5 |
| 3,972,384 | A * | 8/1976 | Hoefs | 181/232 |
| 4,209,493 | A * | 6/1980 | Olson | 422/176 |
| 4,416,350 | A * | 11/1983 | Hayashi | 181/272 |
| 4,436,172 | A * | 3/1984 | Inoue et al. | 180/219 |
| 4,628,689 | A * | 12/1986 | Jourdan | 60/295 |
| 4,842,096 | A * | 6/1989 | Fujitsubo | 181/252 |
| 5,196,655 | A * | 3/1993 | Woods | 181/235 |
| 5,376,341 | A * | 12/1994 | Gulati | 422/179 |
| 5,426,269 | A | 6/1995 | Wagner et al. | |
| 5,732,555 | A | 3/1998 | Gracyalny et al. | |
| 5,808,245 | A * | 9/1998 | Wiese et al. | 181/255 |
| 5,829,250 | A * | 11/1998 | Lane et al. | 60/301 |
| 6,119,451 | A * | 9/2000 | Vogtlin et al. | 60/274 |
| 6,164,066 | A * | 12/2000 | Sakaguchi et al. | 60/302 |
| 6,712,869 | B2 * | 3/2004 | Cheng et al. | 55/418 |
| 7,062,908 | B2 | 6/2006 | Yamamoto | |
| 7,273,592 | B2 * | 9/2007 | Jacob et al. | 422/169 |

(Continued)

FOREIGN PATENT DOCUMENTS

| | | | |
|---|---|---|---|
| GB | 2393481 | A * | 3/2004 |
| JP | 03260314 | | 11/1991 |

*Primary Examiner* — Thomas Denion
*Assistant Examiner* — Anthony Ayala Delgado
(74) *Attorney, Agent, or Firm* — Finnegan, Henderson, Farabow, Garrett & Dunner LLP

(57) ABSTRACT

An aftertreatment module for use with an engine is disclosed. The aftertreatment module may have a first chamber with an inlet, and at least one catalyst substrate disposed in the first chamber in a flow path through the inlet and having a flow direction from an inlet face to an outlet face in general alignment with the flow path. The aftertreatment module may also have a second chamber with at least one outlet in general alignment with the flow direction through the inlet. The aftertreatment module may further have at least one noise attenuation passage fluidly connecting the first chamber with the second chamber. The at least one noise attenuation passage may be oriented generally orthogonal to the inlet and the at least one outlet and be located between the inlet and the outlet face of the at least one catalyst substrate.

20 Claims, 4 Drawing Sheets

U.S. PATENT DOCUMENTS

| | | | | |
|---|---|---|---|---|
| 7,287,622 | B2 * | 10/2007 | Rauch et al. | 181/272 |
| 7,350,349 | B2 * | 4/2008 | Olofsson | 60/295 |
| 8,028,798 | B2 * | 10/2011 | Koyanagi et al. | 181/251 |
| 2001/0045322 | A1 * | 11/2001 | Nilsson et al. | 181/227 |
| 2006/0283661 | A1 * | 12/2006 | Tanaka et al. | 181/269 |
| 2007/0039316 | A1 * | 2/2007 | Bosanec et al. | 60/299 |
| 2007/0125594 | A1 * | 6/2007 | Hill | 181/256 |
| 2007/0289294 | A1 | 12/2007 | Werni et al. | |
| 2008/0155966 | A1 * | 7/2008 | Chang | 60/287 |
| 2009/0158721 | A1 * | 6/2009 | Wieland et al. | 60/297 |

* cited by examiner

EXHAUST SYSTEM HAVING AN AFTERTREATMENT MODULE

TECHNICAL FIELD

The present disclosure is directed to an exhaust system and, more particularly, to an exhaust system having an aftertreatment module.

BACKGROUND

Internal combustion engines, including diesel engines, gasoline engines, gaseous fuel-powered engines, and other engines known in the art generate a complex mixture of air pollutants. The air pollutants are composed of gaseous compounds including, for example, the oxides of carbon, nitrogen, and sulfur ($CO_X$, $NO_X$, and $SO_X$), and solid compounds including, for example, hydrocarbons (HC). Due to increased awareness of the environment, exhaust emission standards have become more stringent, and the amount of air pollutants emitted to the atmosphere by an engine may be regulated depending on the type of engine, size of engine, and/or class of engine.

In order to comply with the regulation of engine emissions, some manufacturers have started using a diesel oxidation catalyst (DOC). A DOC generally consists of a substrate coated with a precious metal catalyst that converts gaseous and solid compounds to harmless substances. The DOC is generally located downstream of an engine's turbochargers, if so equipped, and upstream of an engine's muffler.

In some applications, the DOC substrate may need to be very large to help ensure it has enough surface area or effective volume to convert appropriate amounts of the gaseous and solid compounds. These large substrates, however, can be expensive and require significant amounts of space within the engine's exhaust system. In addition, the substrate may require placement at a precise location within the engine's exhaust flow for proper activation temperatures to be attained and for the exhaust to be evenly distributed across a face of the substrate. This spacing may further increase packaging difficulties of the exhaust system. When improperly sized and/or spaced, the substrate can restrict exhaust flow to some extent and thereby cause an increase in the pressure of exhaust exiting an engine. If this exhaust back pressure is too high, the breathing ability and subsequent performance of the engine could be negatively impacted.

The exhaust system of the present disclosure addresses one or more of the needs set forth above and/or other problems of the prior art.

SUMMARY

One aspect of the present disclosure is directed to an aftertreatment module. The aftertreatment module may include a first chamber with an inlet, and at least one catalyst substrate disposed in the first chamber in a flow path through the inlet and having a flow direction from an inlet face to an outlet face in general alignment with the flow path. The aftertreatment module may also include a second chamber with at least one outlet in general alignment with the flow direction through the inlet. The aftertreatment module may further include at least one noise attenuation passage fluidly connecting the first chamber with the second chamber. The at least one noise attenuation passage may be oriented generally orthogonal to the inlet and the at least one outlet and be located between the inlet and the outlet face of the at least one catalyst substrate.

A second aspect of the present disclosure is directed to a method of treating exhaust. The method may include directing an exhaust flow in a first direction into an aftertreatment module, converting constituents of the exhaust flow during flow in the first direction, and redirecting the exhaust flow from the first direction to a second direction opposite the first direction after constituents in the exhaust flow have been converted. The method may further include redirecting the exhaust flow from the second direction to a third direction substantially orthogonal to the first and second directions, attenuating noise associated with the exhaust flow during flow in the third direction, and redirecting the exhaust flow that has been noise attenuated from the third direction back to the first direction to exit the aftertreatment module.

DETAILED DESCRIPTION

Figure 1:
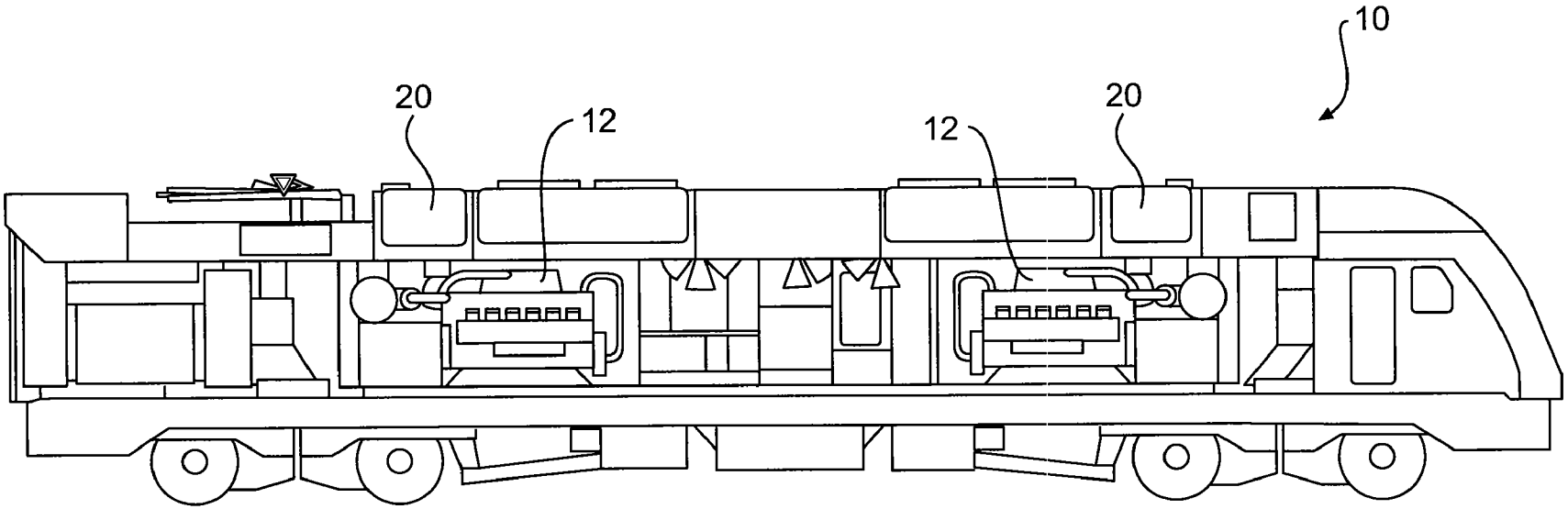
FIG. 1 is a pictorial illustration of an exemplary disclosed power system.

FIG. 1 illustrates an exemplary power system 10. For the purposes of this disclosure, power system 10 is depicted and described as a mobile machine, for example a locomotive, including one or more multi-cylinder internal combustion engines 12. Each engine 12 may be configured to combust a mixture of air and fuel, for example diesel, gasoline, or a gaseous fuel, to generate a mechanical output. The mechanical output from engine 12 may be used to propel the mobile machine. Alternatively, engine 12 may embody the main or auxiliary power source of a stationary machine such as a pump, if desired.

Figure 2:
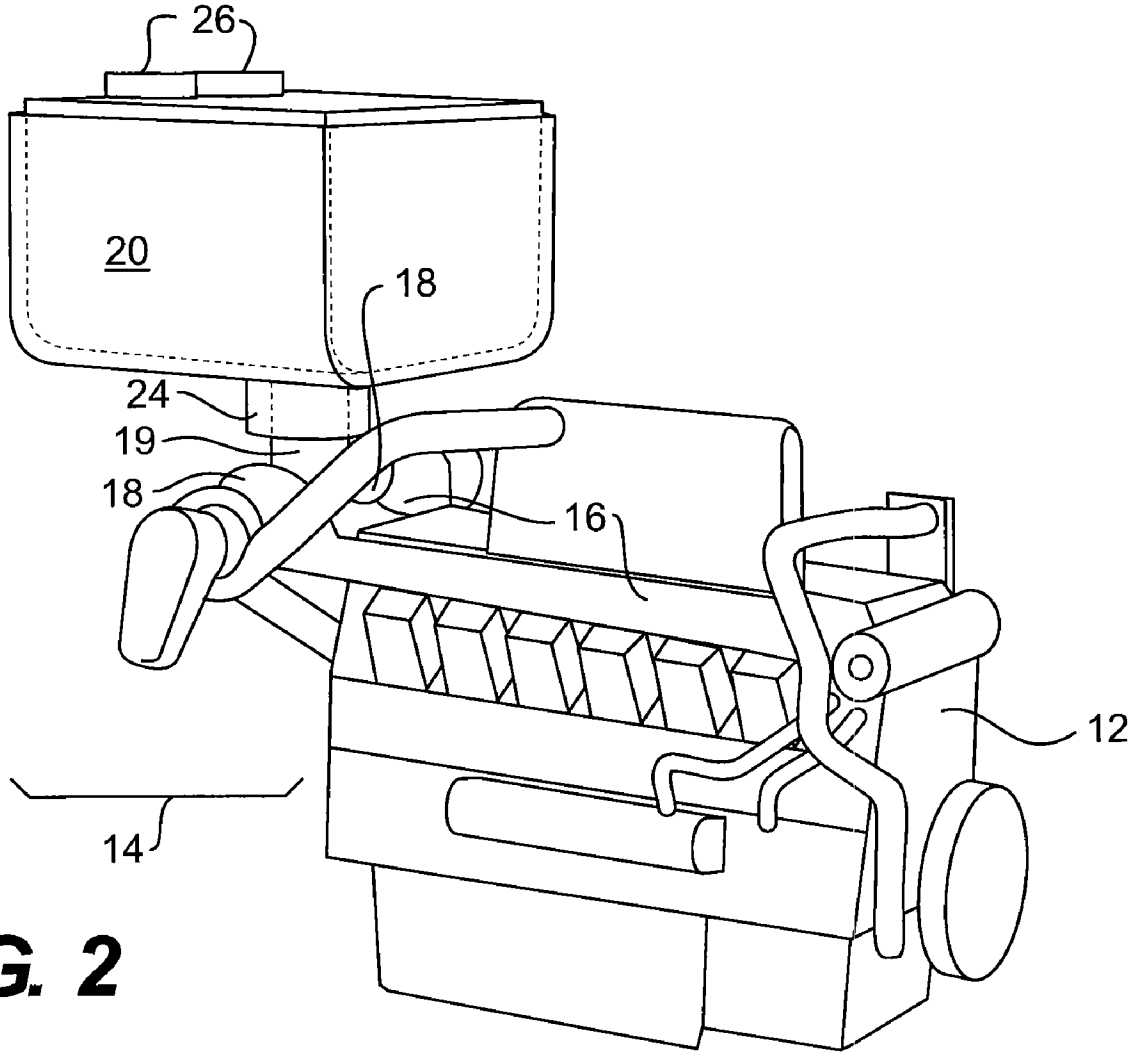
FIG. 2 is a pictorial illustration of an exemplary disclosed engine that may be used with the power system of FIG. 1.

As shown in FIG. 2, engine 12 may be equipped with an exhaust system 14 having components that cooperate to promote the production of power and simultaneously control the emission of pollutants to the atmosphere. For example, exhaust system 14 may include one or more exhaust passages 16 fluidly connected to the cylinders of engine 12, one or more turbochargers 18 driven by exhaust flowing through passages 16, and an aftertreatment module 20 supported by and connected to receive and treat exhaust received from turbochargers 18. In one embodiment, a manifold 19 may collect exhaust from each turbocharger 19 and direct the exhaust vertically upward into aftertreatment module 20. As the hot exhaust gases exiting the cylinders of engine 12 move through turbochargers 18 and expand against vanes (not shown) thereof, turbochargers 18 may be driven to pressurize combustion air drawn into engine 12. Aftertreatment module 20 may convert, treat, condition, and/or otherwise reduce constituents of the exhaust exiting manifold 19 before the exhaust is discharged to the atmosphere.

Figure 3:
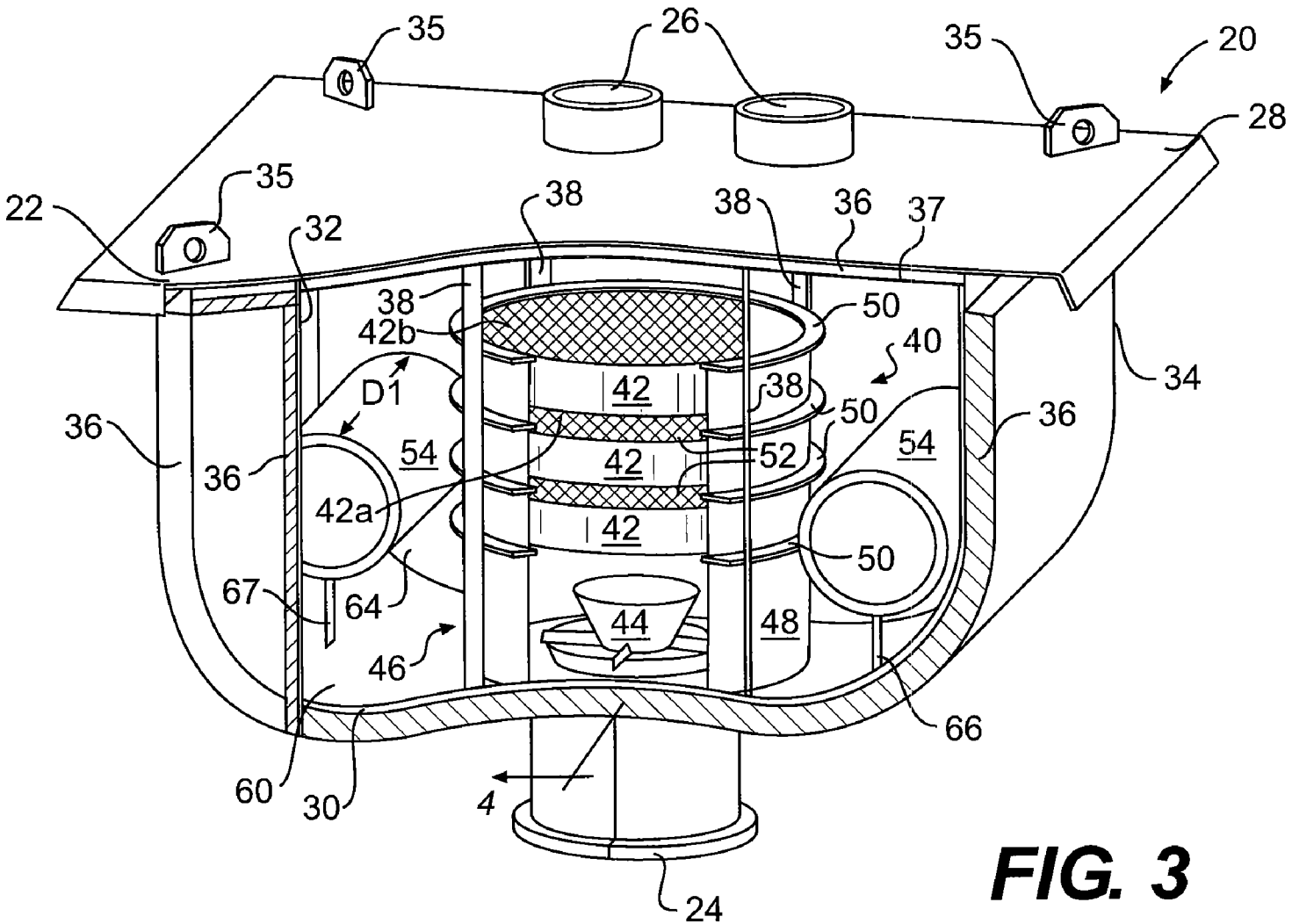
FIG. 3 is a cut-away pictorial illustration of an exemplary disclosed aftertreatment module that may be utilized in conjunction with the engine of FIG. 2.
Figure 4:
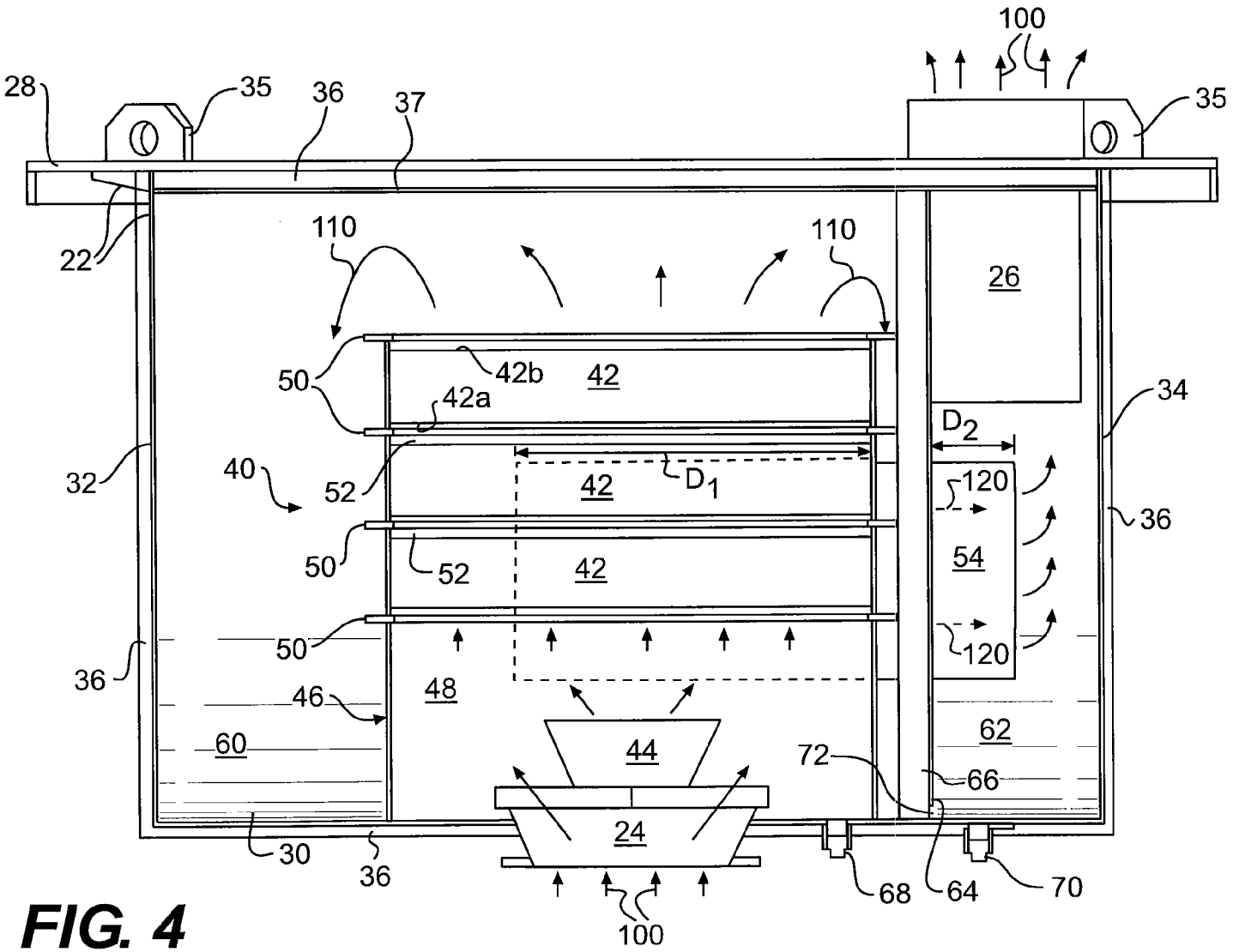
FIG. 4 is a cross-sectional side view illustration of the aftertreatment module of FIG. 3.

As shown in FIGS. 3 and 4, aftertreatment module 20 may include a generally box-like housing 22 having an inlet 24 and one or more outlets 26. Housing 22 may include a top plate 28, a curved and continuous bottom surface 30 that extends downward from top plate 28 on one side and back up to top plate 28 on an opposing side, a generally planar front surface 32 (a portion of which as been cut away to show the inside of aftertreatment module 20), and a generally planar back surface 34. In one embodiment, an additional upper surface 37 may be spaced apart from and located internally to top plate 28, if desired, to provide additional sealing and or strengthening to housing 22. Each of top plate 28, bottom surface 30, front surface 32, back surface 34, and separation surface 36 may be fabricated from stainless steel, and connected to each other, inlet 24, and outlets 26 via welding. Inlet 24 may be stainless steel conduit mounted within bottom surface at a location towards front surface 32, while outlets 26 may be stainless steel conduits mounted within top plate 28 and upper surface 37 at a location towards back surface 34 such that a flow of exhaust may exit housing 22 in the same general direction as the flow of exhaust entered housing 22. Inlet 24 may be vertically located above and operatively connected to turbochargers 18 (referring to FIG. 2) via manifold 19, while outlets 26 may exhaust to the atmosphere. One or more lifting eyes may be associated with aftertreatment module 20 and connected, for example, to top plate 28. It is contemplated that any of top plate 28, front surface 32, back surface 34, and upper surface 37 may be removable from housing 22, if desired, to provide service access to internal components of aftertreatment module 20.

Housing 22 may be supported internally and thermally insulated externally. Specifically, top surface 28 and/or upper surface 37 may be provided with one or more vertical supports 38 that extend from top plate 28 and/or upper surface 37 through a center of housing 22 to bottom surface 30. In this manner, top plate 28 may be capable of supporting large amounts of weight without significant inward deflection. Housing 22 may also be provided with external layers of thermal insulation 36, if desired, such that a desired skin temperature of aftertreatment module 20 may be maintained. In the example of FIGS. 3 and 4, bottom surface 30, front surface 32, back surface 34 and upper surface 37 are provided with external thermal insulation 36.

Housing 22 may be divided into a first chamber 60 that includes inlet 24, and a smaller second chamber 62 (shown only in FIG. 4) that includes outlets 26. Specifically, a separation wall 64 may be connected between top plate 28 or upper surface 37 and bottom surface 30 to form first and second chambers 60, 62. In one embodiment, first chamber 60 may have a volume about two times the volume of second chamber 62. Separation wall 64 may include vertical folds 66 (shown only in FIG. 4) at a center thereof to provide extra space in first chamber 60 for service of exhaust treatment devices.

Aftertreatment module 20 may house one or more exhaust treatment devices that function to convert constituents in the exhaust from engine 12 into harmless substances. For example, FIGS. 3 and 4 illustrate first chamber 60 as housing a bank 40 of oxidation catalysts 42. In one embodiment, bank 40 may include three substantially identical oxidation catalysts 42 arranged in series in a center of first chamber 40, such that first chamber 50 completely surrounds oxidation catalysts 42. Oxidation catalysts 42 may be located downstream of inlet 24 and, in one embodiment, also downstream of a diffuser 44 associated with inlet 24. Diffuser 44 may be configured as a cone or multiple concentric cones, although any diffuser geometry known in the art may be utilized. Each diffuser 44 may be configured to distribute exhaust received from inlet 24 in a substantially uniform manner across a face of a leading oxidation catalyst 42.

Each oxidation catalyst 42 may be, for example, a diesel oxidation catalyst (DOC). As DOCs, oxidation catalysts 42 may each include a porous ceramic or metallic honeycomb structure, a metal mesh, a metal or ceramic foam, a combination of these materials, or another suitable substrate coated with, impregnated with, or otherwise containing a catalyzing material, for example a precious metal, that catalyzes a chemical reaction to alter a composition of exhaust passing through aftertreatment module 20. In one embodiment, oxidation catalysts 42 may include palladium, platinum, vanadium, or a mixture thereof that facilitates the oxidation of harmful emissions. For example, the catalyzing material of oxidation catalysts 42 may help to convert or otherwise reduce CO, NO, HC, and/or other constituents of the exhaust from engine 12 into harmless substances such as $CO_2$, $NO_2$, and $H_2O$. In another embodiment, oxidation catalysts 42 may alternatively or additionally perform particulate trapping functions (i.e., oxidation catalysts 42 may be catalyzed particulate traps), if desired.

In the depicted embodiment, oxidation catalysts 42 may be arranged in series within a common substrate housing 46 and located within a flow path of inlet 24. Substrate housing 46 may include an outer shell 48 having a plurality of annular rings 50 that divide substrate housing 46 into separate compartments, each compartment supporting and containing one oxidation catalyst 42. In an exemplary embodiment, a space 52 of, for example, about one inch may be maintained between oxidation catalysts 42. Space 52 may allow for thermal expansion of oxidation catalysts 42, promote an even distribution of exhaust across the faces of oxidation catalysts 42, and provide a level of noise attenuation in conjunction with oxidation catalysts 42. Oxidation catalysts 42 may include a flow direction from an inlet face 42*a* to an outlet face 42*b* that is in general alignment with the flow direction through inlet 24.

One or more noise attenuation passages 54 may fluidly connect first chamber 60 with second chamber 62. Attenuation passages 54 may include any type of geometry known in the art for attenuating noise, for example baffles, perforated screens, insulation, etc. Attenuation passages 54 may be oriented generally orthogonal to a flow direction through inlet 24 and outlets 26, and vertically located between inlet 24 and outlet face 42*b* of the trailing oxidation catalyst 42 (i.e., about midway between upper surface 37 and bottom surface 30). To enhance attenuation of sound within first and second chambers 60, 62, attenuation passage 54 may extend into first chamber 60 a distance $D_1$ equal to about one-third to one-half a distance from separation wall 64 to front surface 32, and likewise extend into second chamber 62 a distance $D_2$ equal to about one-third to one-half a distance from separation wall 64 to back face 34. A similar extension of outlets 26 into second chamber 62 may also help to attenuate noise within aftertreatment module 20. To support the distal ends of attenuation passages 54 within first chamber 60, one or more vertical supports 67 (shown only in FIG. 3) may extend from bottom surface 30 to attenuation passages 54 at the distal ends.

One or more drains may be associated with aftertreatment module 20 and configured to allow moisture that has collected within aftertreatment module 20 to drain to the atmosphere. In an exemplary embodiment, aftertreatment module includes a condensation drain 68 (shown only in FIG. 4) associated with first chamber 60, and a rain drain 70 (shown only in FIG. 4) associated with second chamber 62. Condensation drain 68 may be located within substrate housing 48 and selectively opened by a service technician to drain substrate housing 48, while rain drain 70 may always be open. A drain passage 72 (shown only in FIG. 4) extending through separation wall 64 may connect first and second chambers 60, 62 such that a buildup of moisture within first chamber 60 outside of substrate housing 48 may be drained via rain drain 70.

INDUSTRIAL APPLICABILITY

The aftertreatment module of the present disclosure may be applicable to any power system configuration requiring exhaust constituent conditioning, where component packaging and noise attenuation are important issues. The disclosed aftertreatment module may improve packaging by utilizing multiple small reduction devices and by efficiently using available space for multiple purposes (e.g., for constituent reduction and noise attenuation), while still evenly distributing exhaust flow across appropriate catalysts. Operation of power system 10 will now be described.

Referring to FIGS. 1 and 2, turbochargers 18 may pressurize and force air or a mixture of fuel and air into the cylinders of engine 12 for subsequent combustion. The fuel and air mixture may be combusted by engine 12 to produce a mechanical rotation that propels or otherwise drives power system 10 and an exhaust flow of hot gases. The exhaust flow, containing a complex mixture of gaseous and solid air pollutants, may be directed through passages 16 to turbochargers 18 and aftertreatment module 20.

Referring to FIG. 4, the exhaust from manifold 19 may flow vertically upward and directly into first chamber 60 of aftertreatment module 20 in a first direction (i.e., in a general direction extending from bottom surface 30 towards top plate 28 represented by arrows 100) via inlet 24. From inlet 24, the flow of exhaust may pass in the first direction through diffuser 44 to bank 40 of oxidation catalysts 42. The location of oxidation catalysts 42 directly above manifold 19 in alignment with the first flow direction (i.e., the lack of directional flow changes before oxidation catalysts 42) may help reduce a back pressure caused by aftertreatment module 20. Diffuser 44 may help to evenly distribute incoming exhaust across the faces of oxidation catalysts 42. As the exhaust flow passes through oxidation catalysts 42 in the first direction, some of the gaseous and solid constituents within the exhaust flow may be converted to harmless substances.

After passing through oxidation catalysts 42, the exhaust flow may be redirected to a second direction opposite the first direction (i.e., in a direction extending from top plate 28 toward bottom surface 30 represented by arrows 110). This redirected exhaust flow, once it reaches the openings of attenuation passages 54, may be divided into two flows and again be redirected, from the second direction to a third direction through attenuation passages 54 (i.e., in a direction substantially orthogonal to the first and second directions represented by arrows 120). As the exhaust flow passes through attenuation passages 54, sound associated with the flow may reverberate therein and dissipate. The extension of attenuation passages 54 into first and second chambers 60, 62 may enhance the attenuation effects.

The exhaust flow exiting first chamber 60 via attenuation passages 54 may be redirected once again back to the first direction to exit second chamber 62 and aftertreatment module 20 via outlets 26. Additional noise associated with the flow of exhaust in second chamber 62 may be attenuated at outlets 26 due to their extension into second chamber 62.

As exhaust is flowing in the first direction from turbochargers 18 into first chamber 60, moisture entrained within the exhaust may condense on walls of first chamber 60 and/or on walls of substrate housing 48. This moisture may be selectively drained from substrate housing 48 by selectively opening condensation drain 68. Moisture within first chamber 60 that is outside of substrate housing 48 may pass to second chamber 62 via drain passage 72. Any moisture that has condensed within second chamber 62 from the exhaust flowing in the first direction, that has passed from first chamber 60 to second chamber 62, and/or that has precipitated into second chamber 62 via outlets 26 may always be drained from second chamber 62 via rain drain 70.

Aftertreatment module 20 may promote even exhaust distribution in a low-cost, compact package. For example, diffuser 44 may help to distribute exhaust evenly across the face of upstream oxidation catalysts 42, while the spacing between upstream and downstream oxidation catalysts 42 may further promote distribution. In addition, attenuation passages 54 may make use of otherwise wasted space to dissipate noise, resulting in packaging simplicity and multi-use functionality that lowers the cost of aftertreatment module 20.

It will be apparent to those skilled in the art that various modifications and variations can be made to the exhaust system and aftertreatment module of the present disclosure without departing from the scope of the disclosure. Other embodiments will be apparent to those skilled in the art from consideration of the specification and practice of the system and module disclosed herein. It is intended that the specification and examples be considered as exemplary only, with a true scope of the disclosure being indicated by the following claims and their equivalent.

What is claimed is:

1. An aftertreatment module, comprising:

a first chamber having an inlet disposed in a first surface of the first chamber;

at least one catalyst substrate having an outer shell, the at least one catalyst substrate being disposed in the first chamber in a flow path through the inlet and having a flow direction from an inlet face to an outlet face in general alignment with the flow path;

a second chamber having at least one outlet in general alignment with the flow direction through the inlet; and at least one noise attenuation passage fluidly connecting the first chamber with the second chamber, the at least one noise attenuation passage oriented generally orthogonal to the inlet and the at least one outlet and located outside of the outer shell, a distance from the at least one noise attenuation passage to the first surface being less than a distance from the outlet face of the at least one catalyst substrate to the first surface.

2. The aftertreatment module of claim 1, wherein the first and second chambers share a separation wall.

3. The aftertreatment module of claim 2, wherein the at least one noise attenuation passage extends from the separation wall into the first chamber a length about equal to one-third to one-half of a distance from the separation wall to an opposing side wall of the first chamber.

4. The aftertreatment module of claim 3, wherein the aftertreatment module includes a support extending from a bottom surface to a distal end of the at least one noise attenuation passage.

5. The aftertreatment module of claim 1, further including:

a condensation drain that is associated with the first chamber and selectively open; and a rain drain that is associated with the second chamber and always open.

6. The aftertreatment module of claim 5, further including a drain passage connecting the first chamber with the second chamber.

7. The aftertreatment module of claim 1, wherein the at least one catalyst substrate includes three substantially identical catalyst substrates disposed in series.

8. The aftertreatment module of claim 7, further including:

a substrate housing disposed within the first chamber; and a plurality of rings connected to the substrate housing and separating and supporting the catalyst substrates.

9. The aftertreatment module of claim 8, wherein the first chamber completely surrounds the substrate housing.

10. The aftertreatment module of claim 1, further including:

a top plate common to the first and second chambers;

a bottom surface common to the first and second chambers; and a plurality of structural supports extending from the top plate to the bottom surface, through a center portion of at least one of the first and second chambers.

11. The aftertreatment module of claim 1, further including at least one diffuser located at the inlet.

12. The aftertreatment module of claim 1, wherein the at least one outlet includes two outlets.

13. The aftertreatment module of claim 1, wherein the at least one outlet extends into the second chamber a length of about one-third to one-half of a distance from a top plate that supports the at least one outlet to a bottom surface.

14. A method of treating exhaust, comprising:

directing an exhaust flow in a first direction into an aftertreatment module;

converting constituents of the exhaust flow during flow in the first direction;

redirecting the exhaust flow from the first direction to a second direction opposite the first direction after constituents in the exhaust flow have been converted;

redirecting the exhaust flow from the second direction to a third direction substantially orthogonal to the first and second directions;

attenuating noise associated with the exhaust flow during flow in the third direction; and redirecting the exhaust flow that has been noise attenuated from the third direction back to the first direction to exit the aftertreatment module.

15. The method of claim 14, further including draining moisture from the exhaust flow in the first direction before and after attenuation.

16. The method of claim 15, wherein draining includes selectively draining moisture from the exhaust flow in the first direction before attenuation, and always draining moisture from the exhaust flow in the first direction after attenuation.

17. The method of claim 15, further including passing moisture drained from the exhaust flow in the first direction before attenuation to join with moisture drained from the exhaust flow in the first direction after attenuation.

18. The method of claim 14, further including diffusing the exhaust flow in the first direction to improve the converting.

19. The method of claim 14, further including dividing the exhaust flow in the first direction into two exhaust flows in the first direction before exiting the aftertreatment module.

20. A power system, comprising:

a combustion engine having a plurality of cylinders;

a turbocharger connected to receive exhaust from the plurality of cylinders; and an aftertreatment module connected to and supported by the turbocharger and configured to condition an exhaust flow from the turbocharger, the aftertreatment module including:

a top plate;

a bottom surface;

at least one side wall connected between the top plate and the bottom surface to form an enclosure;

a separation wall disposed between the top plate and the bottom surface to divide the enclosure into a first chamber and a second chamber;

an inlet disposed in the bottom surface in fluid communication with the first chamber;

at least one catalyst substrate having an outer shell, the at least one catalyst substrate being disposed in the first chamber in a flow path through the inlet and having a flow direction from an inlet face to an outlet face in general alignment with the flow path;

at least one outlet disposed in the top plate in fluid communication with the second chamber and in general alignment with the flow direction through the inlet; and at least one noise attenuation passage disposed within the separation wall and fluidly connecting the first chamber with the second chamber, the at least one noise attenuation passage oriented generally orthogonal to the inlet and the at least one outlet and located outside of the outer shell, a distance from the at least one noise attenuation passage to the bottom surface being less than a distance from the outlet face of the at least one catalyst substrate to the bottom surface.

* * * * *